US006325162B1

(12) United States Patent
Eppink et al.

(10) Patent No.: US 6,325,162 B1
(45) Date of Patent: Dec. 4, 2001

(54) BIT CONNECTOR

(75) Inventors: Jay M. Eppink, Hollybrush; Albert C. Odell, II, Kingwood; David E. Rios-Aleman, Houston, all of TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 09/376,756

(22) Filed: Aug. 17, 1999

Related U.S. Application Data

(63) Continuation-in-part of application No. 08/984,846, filed on Dec. 4, 1997, now Pat. No. 6,213,226.

(51) Int. Cl.[7] ..... E21B 7/08; E21B 17/02

(52) U.S. Cl. ..... 175/57; 175/74; 175/320; 175/325.2

(58) Field of Search ..... 175/57, 73, 74, 175/320, 325.2

(56) References Cited

U.S. PATENT DOCUMENTS

| | | | | |
|---|---|---|---|---|
| 3,753,470 | | 8/1973 | Lagerstrom et al. | 175/292 |
| 3,851,719 | * | 12/1974 | Thompson et al. | 175/406 |
| 4,185,704 | * | 1/1980 | Niixon, Jr. | 175/76 |
| 4,560,013 | | 12/1985 | Beimgraben | 175/73 |
| 4,591,010 | | 5/1986 | Persson | 175/320 |
| 4,620,600 | | 11/1986 | Persson | 175/73 |
| 4,770,259 | | 9/1988 | Jansson | 175/258 |
| 4,877,092 | * | 10/1989 | Helm et al. | 175/74 |
| 5,050,692 | | 9/1991 | Beimgraben | 175/61 |
| 5,402,856 | * | 4/1995 | Warren et al. | 175/57 |
| 5,423,389 | * | 6/1995 | Warren et al. | 175/75 |
| 5,495,899 | * | 3/1996 | Pastusek et al. | 175/57 |
| 5,678,644 | * | 10/1997 | Fielder | 175/391 |
| 5,957,223 | * | 9/1999 | Doster et al. | 175/57 |

* cited by examiner

*Primary Examiner*—Hoang Dang
(74) *Attorney, Agent, or Firm*—Conley, Rose & Tayon, P.C.

(57) ABSTRACT

The drilling assembly includes an eccentric adjustable diameter blade stabilizer, having a housing with a fixed stabilizer blade and a pair of adjustable stabilizer blades, and a bi-center bit, having an eccentric reamer section and a pilot bit, mounted on the eccentric stabilizer. The stabilizer and bit have an alignment mechanism for aligning the fixed blade with the reamer section. The alignment mechanism includes an aperture on the bit which is aligned with an aperture on the stabilizer as the stabilizer is made up on the bit. An alignment member is received by the aligned apertures for maintaining the alignment.

22 Claims, 5 Drawing Sheets

BIT CONNECTOR

CROSS-REFERENCE TO RELATED APPLICATIONS

This is a continuation-in-part of U.S. patent application Ser. No. 08/984,846 filed Dec. 4, 1997 entitled Directional Drilling Assembly And Method, now U.S. Pat. No. 6,213, 226, hereby incorporated herein by reference.

BACKGROUND OF THE INVENTION

The present invention relates to connectors for connecting stabilizers and bits and more particularly to connecting eccentric adjustable blade stabilizers to bi-center bits having eccentric reamers.

In the drilling of oil and gas wells, concentric casing strings are installed and cemented in the borehole as drilling progresses to increasing depths. In supporting additional casing strings within the previously run strings, the annular space around the newly installed casing string is limited. Further, as successive smaller diameter casings are suspended within the well, the flow area for the production of oil and gas is reduced. To increase the annular area for the cementing operation and to increase the production flow area, it has become common to drill a larger diameter new borehole below the terminal end of the previously installed casing string and existing cased borehole so as to permit the installation of a larger diameter casing string which could not otherwise have been installed in a smaller borehole. By drilling the new borehole with a larger diameter than the inside diameter of the existing cased borehole, a greater annular area is provided for the cementing operation and a subsequently suspended new casing string with a larger inner diameter provides a larger flow area for the production of oil and gas.

Various methods have been devised for passing a drilling assembly through the existing cased borehole and permitting the drilling assembly to drill a larger diameter new borehole than the inside diameter of the upper existing cased borehole. One such method includes the use of a winged reamer disposed above a conventional bit and another method includes the use of a bi-center bit. Various types of bi-center bits are manufactured by Diamond Products International, Inc. of Houston, Tex. See the Diamond Products International brochure incorporated herein by reference.

A bi-center bit is a combination reamer and pilot bit. The pilot bit is disposed on the downstream end of the drilling assembly with the reamer disposed upstream of the pilot bit. The pilot bit drills a pilot borehole on center in the desired trajectory of the well path and then the eccentric reamer follows the pilot bit reaming the pilot borehole to the desired diameter for the new borehole. The diameter of the pilot bit is made as large as possible for stability and yet still be able to pass through the existing cased borehole and allow the bi-center bit to drill a borehole that is approximately 15% larger than the diameter of the existing cased borehole.

The drilling assembly must have a pass-through diameter which will allow the assembly to pass down through the existing cased borehole and then pass back up the new borehole and existing cased borehole upon completion of drilling. The reamer section of the bi-center bit is eccentric and typically the bi-center bit is used with a stabilizer having a fixed eccentric blade. The stabilizer is located above the reamer section of the bi-center bit such that they must pass together through the upper existing cased borehole. The stabilizer and bi-center bit must be sized so that the drilling assembly has a pass-through diameter which will allow the drilling assembly to pass through the existing cased borehole without excessive wedging.

Typically a fixed blade stabilizer is mounted above the bit on the drilling assembly. The fixed blade stabilizer includes a plurality of blades azimuthally spaced around the circumference of the housing of the stabilizer with the outer edges of the blades being concentric and adapted to contact the wall of the existing cased borehole. The stabilizer housing has approximately the same outside diameter as the bi-center bit. Obviously, the fixed blade stabilizer must have a diameter which is smaller than the inside diameter of the upper existing cased borehole, i.e. pass-through diameter. In fact the fixed blade stabilizer must have a diameter which is equal to or less than outside diameter of the pilot bit of the bi-center bit. Therefore, it can be appreciated that the blades of the fixed blade stabilizer will not all simultaneously contact the wall of the new borehole since the new borehole will have a larger diameter than that of the upper existing cased borehole.

An adjustable concentric blade stabilizer may be used on the drilling assembly. The adjustable stabilizer allows the blades to be collapsed into the stabilizer housing as the drilling assembly passes through the upper existing cased borehole and then expanded within the new larger diameter borehole whereby the stabilizer blades engage the wall of the new borehole to enhance the stabilizer's ability to keep the pilot bit center line in line with the center line of the borehole. One type of adjustable concentric stabilizer is manufactured by Halliburton, Houston, Tex. and is described in U.S. Pat. Nos. 5,318,137; 5,318,138; and 5,332, 048, all hereby incorporated herein by reference. Another type of adjustable concentric stabilizer is manufactured by Anderguage U.S.A., Inc., Spring, Tex. See Andergauge World Oil article and brochure incorporated herein by reference.

It is preferred that the stabilizer be only two or three feet above the bi-center bit to ensure that the pilot bit drills on center. Having the stabilizer near the bi-center bit is preferred because not only does the stabilizer maintain the pilot bit on center, but the stabilizer also provides a fulcrum for the drilling assembly to direct the drilling direction of the bit.

The present invention overcomes the deficiencies of the prior art.

SUMMARY OF THE INVENTION

The method and apparatus of the present invention includes a drilling assembly having an eccentric adjustable diameter blade stabilizer located within a few feet of the bi-center bit to become a near bit stabilizer. The drilling assembly is passed through an existing cased borehole to drill a new borehole using the eccentric reamer section and a pilot bit of the bi-center bit. As the assembly is passed through the existing cased borehole, the adjustable blades of the eccentric adjustable diameter blade stabilizer are in their contracted position causing the axes of the bi-center bit and eccentric stabilizer to coincide and then the adjustable blades are extended to their extended position to shift the axis of the eccentric stabilizer back to that of the borehole so that the eccentric stabilizer stabilizes the pilot bit in the desired direction of drilling as the eccentric reamer section reams the new borehole. Once drilling is completed, the blades are retracted so that the drilling assembly can pass back up through the existing cased borehole to the surface.

The drilling assembly of the present invention includes a alignment mechanism for aligning and connecting the bi-center bit to the eccentric adjustable diameter blade stabilizer such that the fixed blade of the eccentric stabilizer and the reamer section of the bi-center bit are and remain in alignment. The alignment mechanism includes an alignment aperture in an upset extending from the housing of the bi-center bit and another alignment aperture in an upset extending from the housing of the eccentric stabilizer. The alignment apertures are aligned upon the predetermined make-up of the connection between the bi-center bit and the eccentric stabilizer. An alignment member is received within the aligned apertures to maintain the alignment and to circumferentially lock the eccentric stabilizer to the bi-center bit.

Rather than have the alignment aperture in an upset integral with the housing of the bi-center bit, an extended housing may be connected to the bi-center bit which has an alignment aperture in an upset on the housing. The bi-center bit and extended housing each have a plurality of alignment apertures along their inside diameter which are timed circumferentially by spacers at the torque shoulders of the rotary shoulder connection between the bi-center bit and the extended housing so as to be in alignment upon the predetermined make-up of the connection. The width of the spacers may be adjusted as required to achieve alignment. Once the connection is timed so that the alignment apertures in the extended housing and eccentric stabilizer are circumferentially aligned, a sleeve with protrusions is engaged from the top connection end of the extended housing. The protrusions extend partially along the outside diameter of the sleeve such that the protrusions are received within the aligned alignment apertures along the inside diameter of the bi-center bit and extended housing. Once in place, the sleeve locks the connection from becoming tightened or loosened without a substantial increase in external torque across the connection as compared to the make up torque of the connection. The eccentric adjustable diameter blade stabilizer is then threaded onto the extended housing with a spacer causing the alignment of the alignment apertures on the upsets on the extended housing and eccentric stabilizer. The alignment member is then inserted into the aligned apertures in the upsets such that the fixed blade on the stabilizer will be aligned axially with the reamer of the bi-center bit.

Other objects and advantages of the invention will appear from the following description.

BRIEF DESCRIPTION OF THE DRAWINGS

For a detailed description of a preferred embodiment of the invention, reference will now be made to the accompanying drawings wherein.

DESCRIPTION OF PREFERRED EMBODIMENTS

Figure 1:
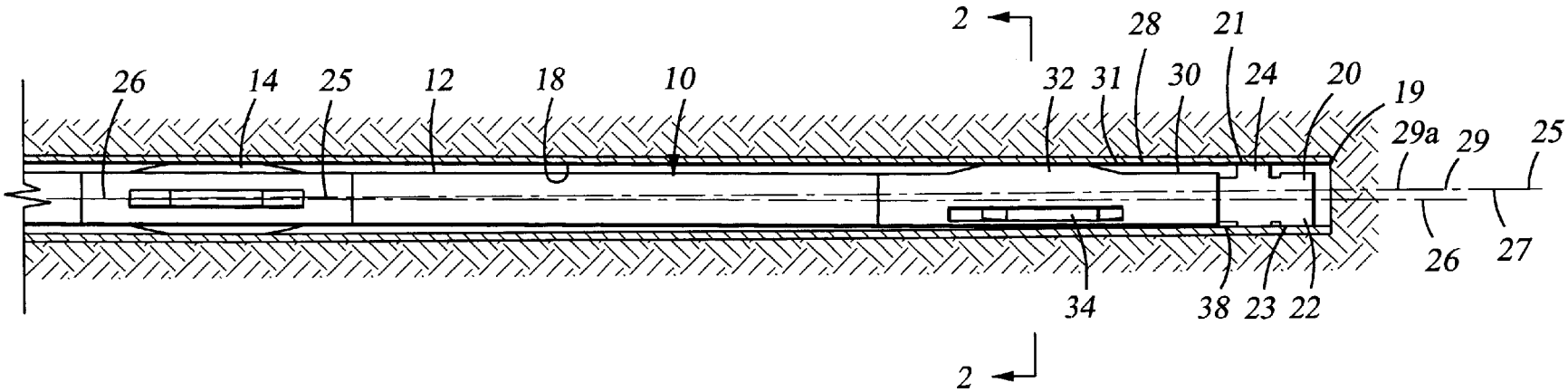
FIG. 1 is a diagrammatic elevation view showing a rotary drilling assembly with a bi-center bit, an eccentric adjustable diameter blade stabilizer, one or more drill collars, and an upper fixed blade stabilizer.

The present invention relates to methods and apparatus for aligning and connecting an eccentric stabilizer near a bi-center bit and passing the assembly through an existing cased borehole to drill a new borehole. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein.

Figure 2:
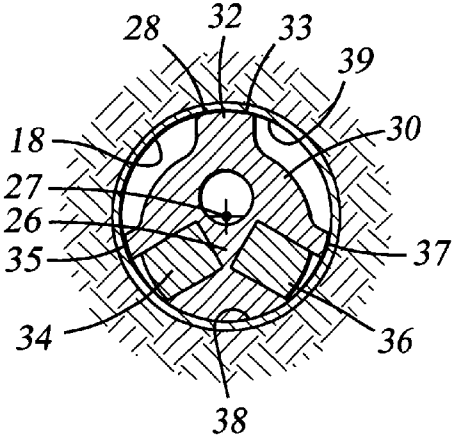
FIG. 2 is a cross-section view taken at plane 2—2 in FIG. 1 showing the eccentric adjustable diameter blade stabilizer in an existing cased borehole in the contracted position.

Referring initially to FIGS. 1 and 2, there is shown a bottom hole assembly 10 including a bi-center bit 20, an eccentric adjustable diameter blade stabilizer 30, one or more drill collars 12, and a fixed blade stabilizer 14. One preferred eccentric adjustable diameter blade stabilizer is disclosed in U.S. patent application Ser. No. 08/984,846 filed Dec. 4, 1997 entitled Directional Drilling Assembly and Method, now U.S. Pat. No. 6,213,226, hereby incorporated herein by reference. Although the bottom hole assembly 10 will be described using the eccentric adjustable diameter blade stabilizer 30, it should be appreciated that any of various alternative embodiments may also be used. The stabilizer 30 is located adjacent to and just above the bi-center bit 20. The bi-center bit 20 includes a pilot bit 22 followed by an eccentric reamer section 24. The eccentric adjustable diameter blade stabilizer 30 preferably includes a fixed blade 32 and a pair of adjustable blades 34, 36, preferably located two to three feet above the reamer section 24 of bi-center bit 20. The fixed blade stabilizer 14 is preferably located approximately 30 feet above bi-center bit 20. By locating the eccentric stabilizer near the bi-center bit, the eccentric stabilizer may act as a fulcrum to adjust the direction of drilling of the bi-center bit and to provide greatly improved stability of the drilling assembly. Although bottom hole assembly 10 has been described with an upper fixed blade stabilizer, it should be appreciated that an upper eccentric adjustable diameter blade stabilizer may be used instead with the fixed blades of the upper and lower eccentric adjustable diameter blade stabilizers timed with the reamer section 24 of bi-center bit 20.

FIGS. 1 and 2 illustrate the bottom hole assembly 10 passing through an existing cased borehole 18 having an axis 25, the axis being defined as the centerline of the casing 18. The pilot bit 22 of bi-center bit 20 and fixed stabilizer 14 have an axis 26. As best shown in FIG. 1, fixed blade 32 is aligned with eccentric reamer section 24 such that fixed blade 32 and reamer section 24 are in a common plane engaging one side 28 of the wall 39 of existing cased borehole 18 along a common axial line 31 thereby causing the other side 23 of pilot bit 22 to engage the opposite side 38 of existing cased borehole 18.

The pass-through diameter of existing cased borehole 18 is that diameter which will allow the bottom hole assembly 10 to pass through the bore of existing cased borehole 18. Typically the pass-through diameter is approximately the same as the diameter of the existing cased borehole. As best shown in FIG. 2, adjustable blades 34, 36 are in their collapsed or contracted position with blades 32, 34, and 36 contacting the inner diameter of wall 21 of existing cased borehole 18 at three circumferential areas of contact 33, 35, and 37 approximately 120° apart. In the expanded position, the areas of contact 33, 35, and 37 form an axis which is coincident with axis 26 of the bottom hole assembly 10. In the contracted position, the areas of contact 33, 35, and 37 shift the centerline of eccentric adjustable diameter blade stabilizer 30 to axis 27 which is coincident with the axis 29 of bi-center bit 20, i.e. the pass through axis 29*a*. It can be appreciated that should fixed blade 32 come out of alignment with reamer section 24, the pass-through diameter of the bottom hole assembly 10 is increased and may either prevent the bottom hole assembly from passing down through the bore of the existing cased borehole 18 or may prevent the bottom hole assembly 18 from being retrieved back up through the bore of the existing cased borehole 18 upon completion of drilling. It should be appreciated that if fixed blade 32 and reamer section 24 are no longer in alignment after the new borehole is drilled, the reamer section 24 may no longer pass into the lower end of the cased borehole 18 and may become hung up on the terminal end 19 of the cased borehole 18 such that extreme measures will have to be taken to retrieve the bottom hole assembly 10.

The bottom hole assembly 10 attaches the bi-center bit 20 to the eccentric stabilizer 30 such that the eccentric reamer section 24 of the bi-center bit 20 is aligned with the fix blade 32 or a specific adjustable blade of the eccentric stabilizer 30 in the case of a concentric adjustable blade stabilizer, in a secure manner such that a large torque load during drilling will not cause bit 20 to rotate with respect to stabilizer 30. The eccentric stabilizer 30 and bi-center bit 20 are aligned so that the eccentric stabilizer 30 in its collapsed position will allow the assembly of the stabilizer 30 and bit 20 to pass through the existing cased borehole 18.

Figure 3:
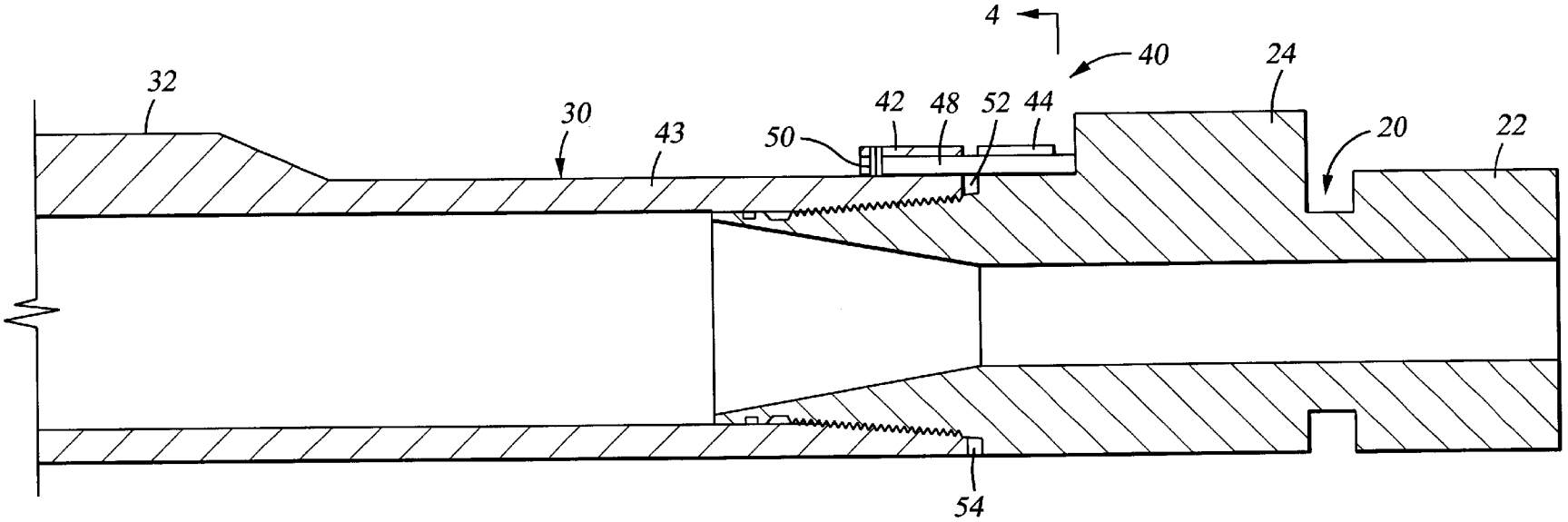
FIG. 3 is a cross-section view of an alignment mechanism for the alignment and connection of the eccentric adjustable diameter blade stabilizer and bi-center bit.
Figure 4:
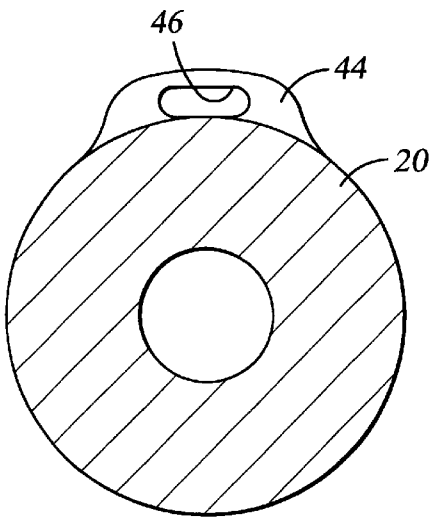
FIG. 4 is a cross-section taken at plane 4—4 in FIG. 3 of the alignment mechanism.

Referring now to FIGS. 3 and 4, bi-center bit 20 and eccentric stabilizer 30 are connected by an alignment mechanism 40 which aligns upon make-up of the connection and then maintains the alignment of reamer 24 with fixed blade 32. Alignment mechanism 40 includes alignment apertures 46 in upsets, such as extended flange members 42, 44, projecting from the housings 43, 21 of stabilizer 30 and bi-center bit 20, respectively, preferably in the plane of fixed blade 32 and reamer section 24, respectively. The alignment apertures 46 are shaped to accept a alignment member 48. Alignment member 48 is held in place by a bolt or spring pin 50 and may be a shear member. The mechanism 40 also includes a spacer 52 having a predetermined thickness such that the threaded connection of the bi-center bit 20 to the stabilizer 30 is timed circumferencially at torque shoulder 54 such that apertures 46 in extended members 42, 44 are aligned upon full make-up, the width of the spacer 52 being adjusted as required to achieve a predetermined number of revolutions for the alignment of apertures 46. The threading of the bi-center bit 20 onto the stabilizer 30 is thus torqued to a specific amount. When that torque is reached, the apertures 46 of members 42, 44 line up axially at the proper connection make-up torque so that the alignment member 48 can be inserted through both apertures 46 and abutted against a protuberance 49, such as reamer section 24, to simultaneously fix the relative rotation between the bit 20 and stabilizer 30 whereby fixed blade 32 and reamer section 24 are aligned axially.

Thus upon assembly, fixed blade 32 is aligned with the reamer section 24 of the bi-center bit 20. This alignment allows the bottom hole assembly 10 to pass through the existing cased borehole 18 both before and after drilling. Fixed blade 32 can be likened to an extension of the reamer section 24 of bi-center bit 20. Alignment member 48 is designed to carry a substantial load so that the connection is locked from becoming either tightened or loosened without a substantial increase in external torque across the connection as compared with the make up torque of the connection. Where alignment member 48 is also a shear member, alignment member 48 may be sheared with a predetermined amount of torque to allow eccentric stabilizer 30 to be unconnected from bit 20. It should also be appreciated that alignment apertures 46 need not be aligned with blade 32 and reamer 24. It is only necessary that alignment apertures 46 be positioned with respect to blade 32 and reamer 24 such that upon making up the connection to align alignment apertures 46, that blade 32 and reamer 24 are also aligned.

Figure 5:
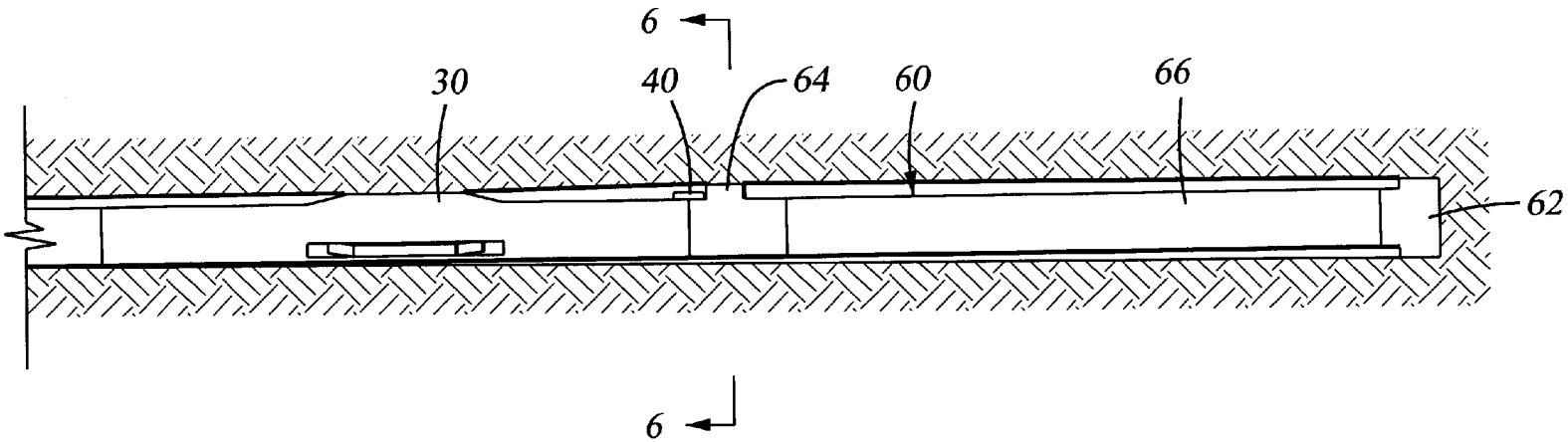
FIG. 5 is a diagrammatic elevation view of a still another embodiment of the drilling assembly of the present invention including a standard drill bit, a drill collar, a winged reamer upstream of the bit, and an eccentric adjustable diameter blade stabilizer mounted above the winged reamer with the blades in the contracted position for passing through an existing cased borehole.
Figure 6:
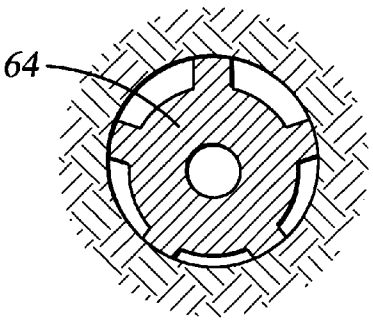
FIG. 6 is a cross-section view taken at plane 6—6 in FIG. 5 showing the winged reamer.
Figure 7:
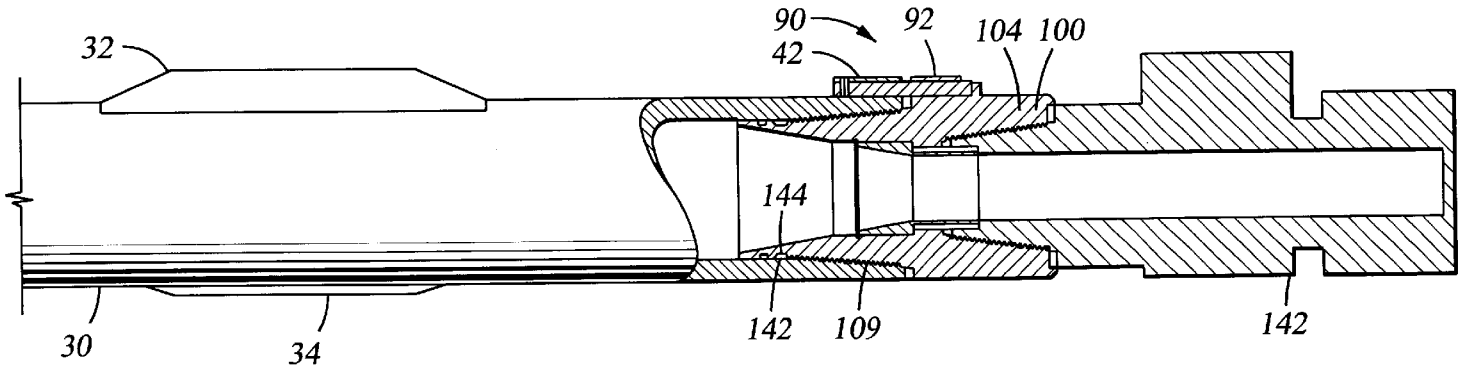
FIG. 7 is an elevation view partly in cross-section showing another alignment mechanism of the present invention including an extended housing for connecting and aligning the eccentric adjustable diameter blade stabilizer and bi-center bit.
Figure 10:
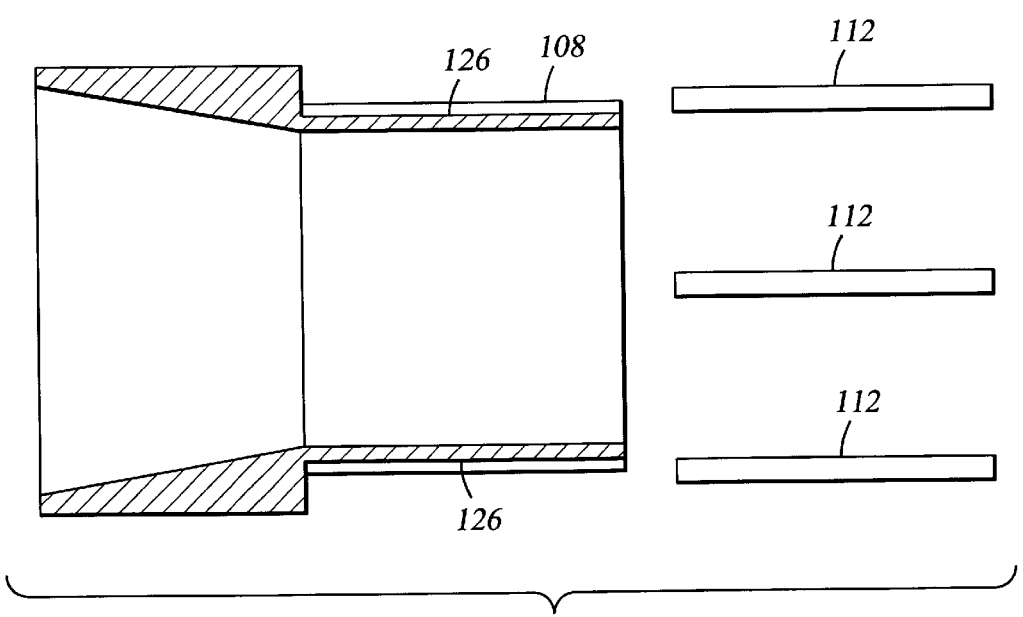
FIG. 10 is a cross-sectional view of the mounting sleeve of FIG. 9 with alignment members shown in an exploded view.

Referring now to FIGS. 5 and 6, there is shown another embodiment of the bottom hole assembly using the eccentric adjustable diameter blade stabilizer 30 of the present invention. The bottom hole assembly 60 includes a standard drilling bit 62 with a winged reamer 64 mounted on drill collars 66 above bit 62. Eccentric adjustable eccentric diameter blade stabilizer 30 is mounted upstream of winged reamer 64. Winged reamer 64 and stabilizer 30 are connected by connector 40 to maintain the alignment of winged reamer 64 and stabilizer 30.

It should also be appreciated that the bottom hole assembly 60 may not include bit 62 and thus only include reamer 64 to reenter an existing borehole for purposes of enlarging the borehole and not for the purpose of drilling a new borehole to a greater depth. In such a case, there is no bit 62 for centering the winged reamer 64.

Referring now to FIGS. 7–10, there is shown another preferred embodiment of the alignment mechanism of the present invention. The bottom hole assembly 70 includes the eccentric adjustable diameter blade stabilizer 30, a bi-center bit 80, and an alignment mechanism 90. This embodiment is particularly advantageous since the bi-center bit 80 may be easily adapted for connection to mechanism 90 with no modifications being made to the housing of bit 80 to accommodate mechanism 90.

Alignment mechanism 90 includes extended flange member 42 on the housing 43 of stabilizer 30 and a mating extended flange member 92 on the housing 94 of an extended housing such as in the form of a cross-over connector sub 100. Each of the extended members 42, 92 has an alignment aperture 46 shaped to accept alignment member 48 which is held in place by a bolt or spring pin 50. Extended housing 100 includes an upper threaded pin end connection 102 for threaded engagement with eccentric stabilizer 30 and a lower threaded box end connection 104 for threaded engagement with bi-center bit 80.

Figure 9:
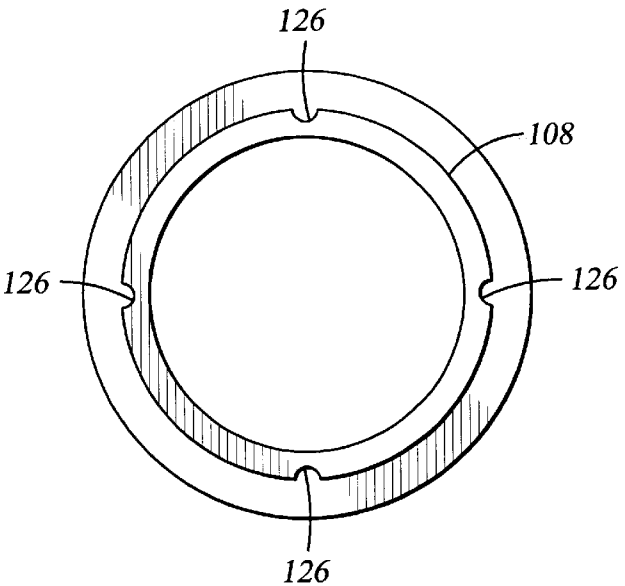
FIG. 9 is a bottom view of the mounting sleeve disposed within the extended housing of FIG. 7.
Figure 8:
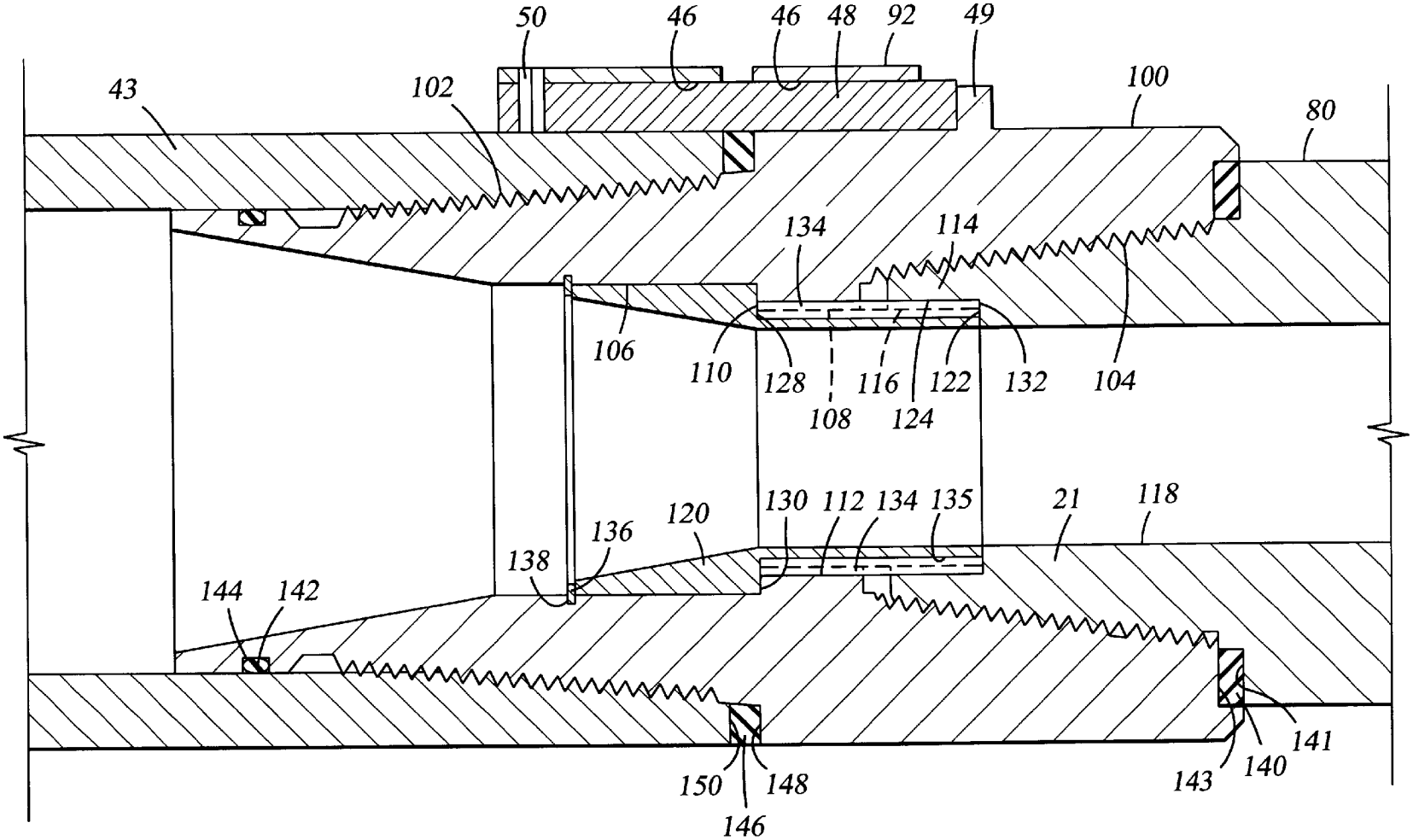
FIG. 8 is an enlarged cross-sectional view of the extended housing shown in FIG. 7.

As best shown in FIGS. 8 and 9, the extended housing 100 includes an enlarged bore 106 and a reduced bore 108 forming an upwardly facing shoulder 110. A plurality of arcuate slots 112 are azimuthally spaced around the inside diameter of reduced diameter bore 108. Likewise, the upstream end 114 of bi-center bit 80 is enlarged to form an enlarged bore 116 with respect to flow bore 118 thus forming an upwardly facing shoulder 122. Enlarged bore 116 includes a plurality of arcuate slots 124 for alignment with slots 112 in extended housing 100.

Alignment mechanism 90 also includes a sleeved member 120 having outwardly directed arcuate slots 126 for alignment with slots 112, 124. Sleeved member 120 has an enlarged head 128 forming a downwardly facing shoulder 130 adapted for engagement with upwardly facing shoulder 110 on extended housing 100 and a lower terminal end 132 adapted for engagement with upwardly facing shoulder 122 on bit 80. Slots 112, 124 and 126 form alignment apertures 135.

A plurality of alignment members in the form of dowels 134 are housed in aligned alignment apertures 135, namely slots 112, 124, and 126, to prevent relative rotation between extended housing 100 and bi-center bit 80. It should be appreciated that sleeve 120 may include integral keys for aligning apertures 135 in place of dowels 134. A retainer member, such as a snap ring 136, is disposed in an annular groove 138 in housing 100 to maintain sleeved member 120 in position. The alignment mechanism 90 includes a spacer 140 having a predetermined thickness such that the threaded connection of the bi-center bit 80 to the housing 100 is timed circumferencially such that the extended members 42, 92 are aligned upon full make-up, the width of the spacer 140 being adjusted as required. Seal members 142 are disposed in annular grooves 144 for sealing sub 100 with stabilizer 30.

In the assembly of the alignment mechanism 90 to align and connect the bi-center bit 80 and eccentric adjustable diameter blade stabilizer 30, the threaded pin end of bi-center bit 80 is threaded into the threaded box end of extended housing 100 with spacer 140 in between shoulders 141 and 143 to align the reamer section 24 with the upset member 92 on housing 100. The slots 124 on the inside diameter of housing 21 of bi-center bit 80 are also circumferentially aligned with the slots 112 on the inside diameter of extended housing 100. The sleeve member 120, with alignment members 134 held in place within slots 126, such as by welding or glue, is then inserted into bores 106, 108 with members 134 being received within alignment apertures 135, i.e., aligned slots 112, 124 and 126. The shoulder 110 holds one end of the alignment members 134 against shoulder 122 of bit 80. The sleeve member 120 is held in place by any of several methods, one of which is snap ring 136. Once in place, this sleeve member 120 locks the connection from becoming tightened or loosened without a substantial increase in external torque across the connection as compared to the make-up torque of the connection.

The threaded pin on the extended housing 100 is then threaded into the threaded box on the downstream end of eccentric stabilizer 30 with a spacer 146 in between shoulders 148, 150 to align the alignment aperture 46 on upset member 42 on stabilizer 30 with the alignment aperture 46 on the upset member 90 on housing 100 such that the fixed blade 32 of eccentric stabilizer 30 is aligned axially with the reamer section 24 of the bi-center bit 80. The alignment member 48 is then inserted into apertures 46 against protuberance 49 and then pin 50 is inserted to hold the alignment mechanism 90 in place.

While a preferred embodiment of the invention has been shown and described, modifications thereof can be made by one skilled in the art without departing from the spirit of the invention.

What is claimed is:

1. An assembly comprising:

a stabilizer having at least one protrusion extending radially thereof;

a bit having a reamer extending radially thereof; said bit threadingly engaging said stabilizer; and an alignment mechanism engaging said stabilizer and bit aligning said protrusion with said reamer and preventing said bit from rotating either clockwise or counter clockwise with respect to said stabilizer.

2. An assembly comprising:

a stabilizer having at least one protrusion extending radially thereof;

a bit having a reamer extending radially thereof;

an alignment mechanism engaging said stabilizer and bit aligning said protrusion with said reamer;

upsets on said stabilizer and bit having apertures receiving an alignment member of said alignment mechanism.

3. An assembly comprising:

a stabilizer having at least one protrusion extending radially thereof;

a bit having a reamer extending radially thereof;

an alignment mechanism engaging said stabilizer and bit aligning said protrusion with said reamer;

said alignment mechanism including a housing disposed between and threadingly engaging said stabilizer and bit, a first alignment member engaging said bit and housing and aligning said bit with said housing and a second alignment member engaging said housing and stabilizer and aligning said housing with said stabilizer whereby said reamer is aligned with said protrusion and said bit and stabilizer are prevented from rotating with respect to said housing.

4. An apparatus comprising:

a stabilizer having at least one blade and a first aperture;

a bit having a reamer section and a second aperture;

said stabilizer and bit having threads forming a connection and aligning said first and second apertures; and a member extending through said first and second aligned apertures.

5. The apparatus of claim 4 further including a spacer disposed between said stabilizer and bit having a thickness causing said apertures to align upon make-up of said connection.

6. The apparatus of claim 4 further including a retainer engaging said member retaining said member in said first and second aligned apertures.

7. An apparatus comprising:

a housing having first and second alignment apertures;

a reamer having a third alignment aperture;

a first alignment member received by said first and third alignment apertures aligning said housing with said reamer;

a stabilizer having a fourth alignment aperture; and a second alignment member received by said second and fourth alignment apertures aligning said stabilizer with said reamer.

8. The apparatus of claim 7 further including spacers disposed between said housing and reamer and between said housing and said stabilizer aligning said alignment apertures.

9. An apparatus comprising:

a housing having threaded ends and first and second alignment apertures;

a reamer having threads engaging said threads on one end of said housing and extending eccentrically from said housing;

a first alignment member aligning a first radially extending member with said reamer;

a stabilizer having threads engaging said threads on the other end of said housing and having a blade extending eccentrically of said housing, said stabilizer having a second radially extending member; and a second alignment member aligning said second radially extending member with said first radially extending member.

10. The apparatus of claim 9 wherein said housing and reamer each include an alignment aperture receiving said first alignment member and a sleeve maintaining said first alignment member within said alignment apertures.

11. A drilling assembly comprising:

an eccentric adjustable blade stabilizer having a fixed blade extending radially in a first direction and two adjustable blades extending at an angle opposite to said first direction;

a bi-center bit connected to said stabilizer and having a pilot bit and an eccentric reamer extending radially in said first direction;

an alignment mechanism mounted on said stabilizer and bit aligning said fixed blade with said reamer; and said adjustable blades having a contracted position for passing said stabilizer and bit through an existing case borehole and an extended position for stabilizing said pilot bit while drilling.

12. The drilling assembly of claim 11 further including a second stabilizer disposed upstream of said eccentric adjustable blade stabilizer.

13. The drilling assembly of claim 12 wherein said second stabilizer is an adjustable concentric blade stabilizer with said blades having multi-positions.

14. The drilling assembly of claim 12 wherein said second stabilizer is an eccentric adjustable blade stabilizer with a fixed blade timed with said eccentric reamer.

15. A drilling assembly comprising:

an eccentric adjustable blade stabilizer;

a winged reamer mounted on the downstream end of said stabilizer;

one or more drill collars disposed downstream of said winged reamer;

a drilling bit disposed on the downstream end of said drill collars;

said eccentric adjustable stabilizer having a fixed blade extending in a direction common to that of said winged reamer and two adjustable blades extending at an angle and in a direction opposite and at an angle to said common direction; and an alignment member attached to said winged reamer and stabilizer aligning said fixed blade with said winged reamer.

16. A method of connecting a drilling assembly including an adjustable blade stabilizer adjacent a bi-center bit comprising:

providing an alignment aperture on the stabilizer in a predetermined position with respect to a blade on the stabilizer;

providing an aperture on the bi-center bit in a predetermined position with respect to a reamer on the bi-center bit;

making up the stabilizer onto the bi-center bit;

aligning the stabilizer alignment aperture with the bi-center bit alignment aperture;

aligning the blade with the reamer; and inserting an alignment member in the aligned apertures maintaining the alignment of the blade and reamer.

17. The method of claim 16 further including:

disposing a spacer between a housing and the bi-center bit;

rotatably connecting the housing onto the bi-center bit with the spacer limiting the make-up of the connection to a predetermined degree; and aligning an alignment aperture on the housing with an alignment aperture on the bi-center bit.

18. The method of claim 16 further including:

contracting one or more adjustable blades of the adjustable blade stabilizer, passing the drilling assembly through an existing casing borehole;

contacting the existing cased borehole with the reamer of the bi-center bit and with one side of a pilot bit on the bi-center bit;

contacting the existing cased borehole with a blade of the adjustable blade stabilizer and a wall of the adjustable blade stabilizer with the adjustable blades in the contracted position and with the contact axis of the stabilizer being coincident with the axis of the bi-center bit;

passing the drilling assembly into a new borehole;

extending the adjustable blades of the adjustable blade stabilizer;

contacting the new borehole with the bi-center bit;

contacting the new borehole with the blades of the stabilizer with the adjustable blades in the extended position and with the contact axis of the stabilizer being coincident with the axis of the pilot bit.

19. An assembly comprising:

a first well tool having a first housing;

a second well tool having a second housing and a predetermined orientation with respect to said first well tool; and a locking mechanism having a first portion extending radially outward from said first housing and a second portion extending radially outward from said second housing, said first and second portions receiving and cooperating with a locking member to interlock said second well tool with said first well tool in said pre-determined orientation to prevent rotation between said first and second well tools.

20. The assembly of claim 19 wherein said first well tool includes at least one protrusion extending radially from said first housing with said locking member orienting said second well tool to said first well tool by engaging said first and second portions and said protrusion.

21. The assembly of claim 19 wherein said first portion and said second portion have an aperture alignable to receive said locking member.

22. The assembly of claim 20 further including a retaining member to lock said locking member in engagement with said protrusion.

* * * * *